US011891824B2

(12) United States Patent
Yamanashi

(10) Patent No.: US 11,891,824 B2
(45) Date of Patent: Feb. 6, 2024

(54) BOOTH

(71) Applicant: OKAMURA CORPORATION, Yokohama (JP)

(72) Inventor: Asuka Yamanashi, Yokohama (JP)

(73) Assignee: OKAMURA CORPORATION, Kanagawa (JP)

( * ) Notice: Subject to any disclaimer, the term of this patent is extended or adjusted under 35 U.S.C. 154(b) by 0 days.

(21) Appl. No.: 17/768,962

(22) PCT Filed: Sep. 25, 2020

(86) PCT No.: PCT/JP2020/036406

§ 371 (c)(1),
(2) Date: Apr. 14, 2022

(87) PCT Pub. No.: WO2021/075234

PCT Pub. Date: Apr. 22, 2021

(65) Prior Publication Data

US 2023/0160225 A1 May 25, 2023

(30) Foreign Application Priority Data

Oct. 18, 2019 (JP) ..... 2019-191478

(51) Int. Cl.
*E04H 1/12* (2006.01)

(52) U.S. Cl.
CPC ..... *E04H 1/125* (2013.01)

(58) Field of Classification Search
CPC ..... E04H 1/1255; E04H 1/125; E04B 2/7416; E04B 2/7422; E04B 2/7438
See application file for complete search history.

(56) References Cited

U.S. PATENT DOCUMENTS 4,685,255 A 8/1987 Kelley
4,874,027 A * 10/1989 Boundy ..... A47B 83/001 160/218

(Continued)

FOREIGN PATENT DOCUMENTS

CN 204889393 12/2015
CN 206792092 12/2017

(Continued)

OTHER PUBLICATIONS

Chinese Office Action (Application No. 2020800722976) dated Sep. 21, 2022 (16pages).

(Continued)

*Primary Examiner* — Christine T Cajilig
(74) *Attorney, Agent, or Firm* — NIXON PEABODY LLP; Jeffrey L. Costellia

(57) ABSTRACT

A booth includes a booth main body including a facing panel, a right-side panel, and a left-side panel, a top plate, and an inclined panel that extends from a booth left front-end portion of the right-side panel of the booth main body while being inclined to become farther from the facing panel toward the right-side panel in the plan view and forms an entrance into the booth main body between the inclined panel and a booth right front-end portion of the right-side panel of the booth main body. The top plate includes a panel side edge portion that extends along at least the facing panel and the right-side panel, and a front edge portion that includes a first edge portion that becomes closer to the facing panel from a first end on the right-side panel side of the front edge portion toward the left-side panel.

9 Claims, 5 Drawing Sheets

(56) References Cited

U.S. PATENT DOCUMENTS

| | | | | | |
|---|---|---|---|---|---|
| 5,086,597 | A * | 2/1992 | Kelley | E04B 2/7416 | 52/239 |
| 5,134,826 | A * | 8/1992 | La Roche | E04B 2/7437 | 52/584.1 |
| 5,423,151 | A * | 6/1995 | Caro | E04B 2/7416 | 181/290 |
| 5,426,900 | A * | 6/1995 | Springer | E06B 3/90 | 52/236.1 |
| 5,743,193 | A * | 4/1998 | Kakuta | A47B 83/001 | 108/106 |
| 5,787,648 | A | 8/1998 | O'Malley | | |
| 6,474,025 | B1 * | 11/2002 | Faiks | A47B 83/001 | 52/64 |
| 7,707,790 | B2 * | 5/2010 | Williams | E04B 2/7416 | 52/282.4 |
| 2002/0045954 | A1 | 4/2002 | Nose et al. | | |
| 2005/0016080 | A1 * | 1/2005 | Williams | E04B 2/7416 | 52/27 |

FOREIGN PATENT DOCUMENTS

| | | | |
|---|---|---|---|
| CN | 110150844 | | 8/2019 |
| DE | 9416068 | U1 * | 10/1994 |
| JP | 05-029368 | | 4/1993 |
| JP | 06-141930 | | 5/1994 |
| JP | 3009775 | | 4/1995 |
| JP | 2002-121917 | | 4/2002 |
| JP | 2003-074138 | | 3/2003 |
| JP | 2003105900 | A | 4/2003 |
| JP | 2004-113810 | | 4/2004 |
| JP | 2008-121313 | | 5/2008 |
| JP | 2012082585 | A | 4/2012 |
| JP | 2014-043765 | | 3/2014 |
| JP | 2016089434 | A | 5/2016 |
| JP | 2016-181017 | | 10/2016 |
| JP | 2018-084032 | | 5/2018 |

OTHER PUBLICATIONS

Japanese Notice of Allowance for Application No. 2019-1914785 dated Mar. 16, 2021 (6 pages).

International Search Report for Application No. PCT/JP2020/036406, dated Nov. 17, 2020 (4 pages).

Japanese Office Action (App. No. 2021-065676) dated Sep. 19, 2023, (6 pgs).

Decision of Refusal for Japanese App. No. 2021-065676, dated Nov. 28, 2023 (6 pages).

* cited by examiner

BOOTH

TECHNICAL FIELD

The present invention relates to a booth.

Priority is claimed on Japanese Patent Application No. 2019-191478, filed Oct. 18, 2019, the content of which is incorporated herein by reference.

BACKGROUND ART

There is a technique in which a partition wall is provided around a desk top plate, of which an upper surface includes a work surface, to improve a work environment on a desk (for example, refer to Patent Document 1). However, in a configuration as disclosed in Patent Document 1, no partition wall is provided behind a worker who works while facing the desk top plate. Therefore, in a case where, for example, a monitor device is used on the desk top plate, contents displayed on the monitor device may be viewed by another person behind the worker.

With regard to this, Patent Document 2 discloses a booth that includes a partially cylindrical screen in which an entrance is formed, and a top plate attached to an inner side of the screen. In such a configuration, a space in which the top plate is provided is surrounded by the screen except for a portion corresponding to the entrance. Therefore, contents displayed on a monitor device used on the top plate are less likely to be viewed from behind a worker.

DOCUMENT OF RELATED ART

Patent Document

Patent Document 1: Registered Japanese Utility Model Publication No. 3009775

Patent Document 2: Japanese Unexamined Patent Application, First Publication No. 2018-84032

SUMMARY OF INVENTION

Technical Problem

The booth as disclosed in Patent Document 2 can have a shape along a regular hexagonal prism, a shape along a regular octagonal prism, a shape along a circular column, or the like as a whole. In a case where the booth has a shape along a regular hexagonal prism, a regular octagonal prism, a circular column or the like, a dead space is formed between the booth and other fixtures, a wall surface or the like in a room where the booth is installed, which hinders effective use of an installation space where the booth is installed.

In addition, Patent Document 2 also discloses that the booth can have a shape along a rectangular parallelepiped or a cube. However, even when the booth has a shape along a rectangular parallelepiped or a cube, effective use of the installation space where the booth is installed is hindered if the size of the booth is increased for improvement of usability inside the booth. On the other hand, if the size of the booth is reduced, a space inside the booth decreases, which leads to a decrease in usability for a user.

An object of the present invention is to provide a booth in which it is possible to increase a space use efficiency in an installation space and to improve usability while limiting a workspace on a top plate from being viewed from behind a user.

Solution to Problem

In order to obtain the above object, an aspect of the present invention is a booth including: a booth main body that includes a first panel, a second panel, and a third panel, the first panel being erected on a floor surface, and the second panel and the third panel being connected to two end portions in a width direction of the first panel and extending in a thickness direction of the first panel in a state where the second panel and the third panel face each other in the width direction; a top plate that is provided in the booth main body and of which an upper surface includes a work surface; and an inclined panel that is connected to a first end portion of the third panel positioned on a side of the third panel distant from the first panel in a plan view, extends to be inclined to become farther from the first panel toward the second panel in the width direction, and forms an entrance into the booth main body between the inclined panel and a first end portion of the second panel positioned on a side of the second panel distant from the first panel.

The top plate includes a panel side edge portion that extends along the first panel and the second panel, and a front edge portion that includes a first edge portion extending in a direction such that the first edge portion becomes closer to the first panel from a first end of the front edge portion positioned on the second panel side of the front edge portion toward the third panel in the width direction.

As described above, the front edge portion is provided with the first edge portion that becomes closer to the first panel from the first end on the second panel side of the front edge portion toward the third panel in a state where the panel side edge portion of the top plate extends along at least the first panel and the second panel. Accordingly, a user who uses the work surface on the top plate while facing the first edge portion of the top plate does not straight face the first panel and is caused to face a corner portion between the first panel and the second panel in the plan view. In this state, since the inclined panel is provided behind the user, a workspace on the top plate is limited from being viewed from behind the user.

In addition, since the booth main body has a rectangular shape in the plan view that is formed by the first panel, the second panel, and the third panel, a dead space can be limited from being formed between the booth main body and other fixtures, walls, and the like provided in an installation space for the booth.

In addition, since the inclined panel is inclined in the same direction as the first edge portion of the front edge portion of the top plate in the plan view, a decrease in the distance between the inclined panel and the front edge portion of the top plate is limited, and thus accessibility with respect to the inside and the outside of the booth main body is made favorable. Furthermore, the work surface of the top plate extends diagonally from the front edge portion toward the corner portion between the first panel and the second panel, and thus a large depth on the work surface as seen from the user can be secured. In addition, in a case where the user uses the work surface of the top plate while sitting on a chair, a space for accommodation of the legs of the user that is under the top plate can also be secured diagonally and widely from the front edge portion of the top plate to the corner portion between the first panel and the second panel. Accordingly, even if the booth main body is reduced in size, usability in the booth can be improved.

Therefore, it is possible to increase a space use efficiency in an installation space and to improve usability while limiting the workspace on the top plate from being viewed from behind the user.

In the booth of the aspect of the present invention, in the plan view, a first virtual line may connect the first end and a second end of the front edge portion positioned closest to the first panel, a second virtual line may be orthogonal to the first virtual line and may pass through a corner portion between the first panel and the second panel, and the inclined panel may be disposed on the second virtual line.

According to such a configuration, the inclined panel is positioned behind the user who uses the work surface on the top plate while facing the first edge portion of the top plate. Therefore, it is possible to reliably prevent the workspace on the top plate from being viewed from behind the user.

In the booth of the aspect of the present invention, the second end of the front edge portion may be separated from the third panel in the width direction, and the front edge portion may include a second edge portion that extends from the second end toward the third panel.

According to such a configuration, a work surface that extends between the second edge portion and a rear edge portion being along the first panel is formed on the third panel side of the top plate as seen from a worker who is positioned to face the first edge portion of the top plate. Accordingly, the space on the work surface of the top plate is widened, and usability for the worker is improved.

In the booth of the aspect of the present invention, the first end of the top plate may be disposed to be closer to the first panel than the first end portion of the second panel.

According to such a configuration, the second panel protrudes in a direction farther from the first panel than the first end of the top plate. Thereby, a line of sight from an area close to the second panel as seen from the worker can be blocked. Accordingly, usability for the worker is improved.

In the booth of the aspect of the present invention, the first edge portion of the top plate and the inclined panel may extend linearly in the plan view.

According to such a configuration, the first edge portion of the top plate and the inclined panel can be easily manufactured, and thus the booth can be provided at a lower cost.

In the booth of the aspect of the present invention, the inclined panel may extend to be parallel with the first edge portion of the top plate in the plan view.

According to such a configuration, since the inclined panel and the first edge portion of the front edge portion of the top plate are parallel with each other, a decrease in the distance between the inclined panel and the front edge portion of the top plate is limited, and thus a decrease in accessibility with respect to the inside and the outside of the booth main body can be limited.

In the booth of the aspect of the present invention, a panel width of the inclined panel from the first end portion of the third panel may be less than a width of the first edge portion of the top plate.

According to such a configuration, it is possible to limit a decrease in the distance between the inclined panel and the first end portion of the second panel caused by the panel width of the inclined panel being made excessively large. Accordingly, a decrease in accessibility with respect to the inside and the outside of the booth main body can be limited.

In the booth of the aspect of the present invention, each of the first end portion of the second panel and a tip end portion of the inclined panel positioned on the second panel side of the inclined panel may be inclined such that a panel width decreases from an outer surface facing an outside of the booth main body to an inner surface facing an inside of the booth main body in the plan view.

According to such a configuration, interference with respect to an inner surface side end portion of the tip end portion of the inclined panel or an inner surface side end portion of the first end portion of the second panel can be limited when an entrance into the booth main body or an exit from the booth main body is performed through the entrance. As a result, a decrease in accessibility with respect to the inside and the outside of the booth main body can be limited.

Effects of Invention

According to the aspect of the present invention, it is possible to increase a space use efficiency in an installation space and to improve usability while limiting a workspace on a top plate from being viewed from behind a user.

DESCRIPTION OF EMBODIMENTS

Hereinafter, an embodiment of a booth according to the present invention will be described with reference to the accompanying drawings. However, the present invention is not limited only to this embodiment. In the embodiment (and modification examples) that will be described below, the corresponding components may be provided with the same reference signs and the description thereof may be omitted. Note that in the following description, for example, an expression of relative or absolute arrangement such as "parallel", "orthogonal", "centered" and "coaxial" shall not be construed as indicating only the arrangement in a strict literal sense but also includes a state where the arrangement is relatively displaced by a tolerance, or by an angle or a distance whereby it is possible to achieve the same function.

Figure 1:
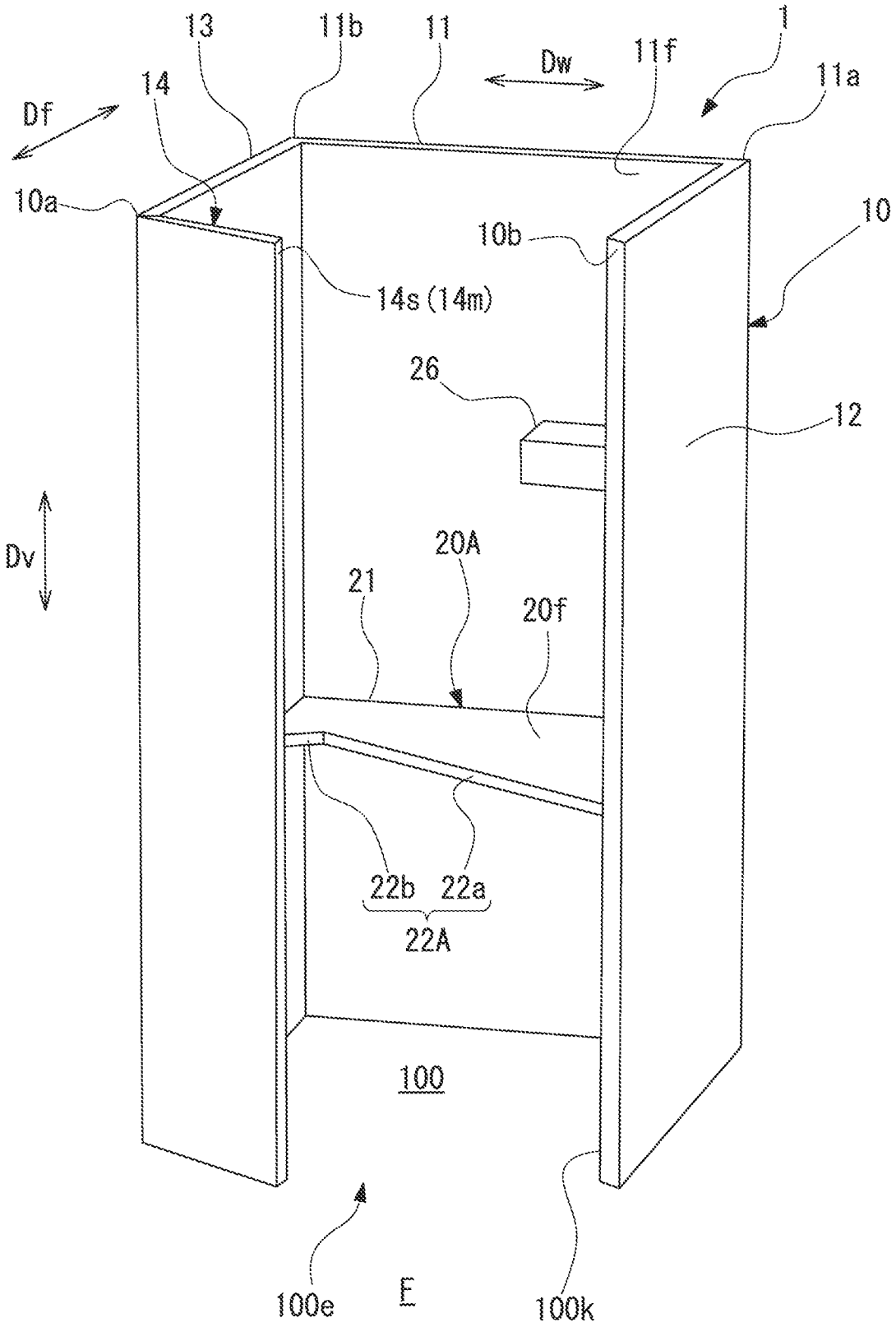
FIG. 1 is a perspective view showing the overall configuration of a booth according to an embodiment of the present invention.
Figure 2:
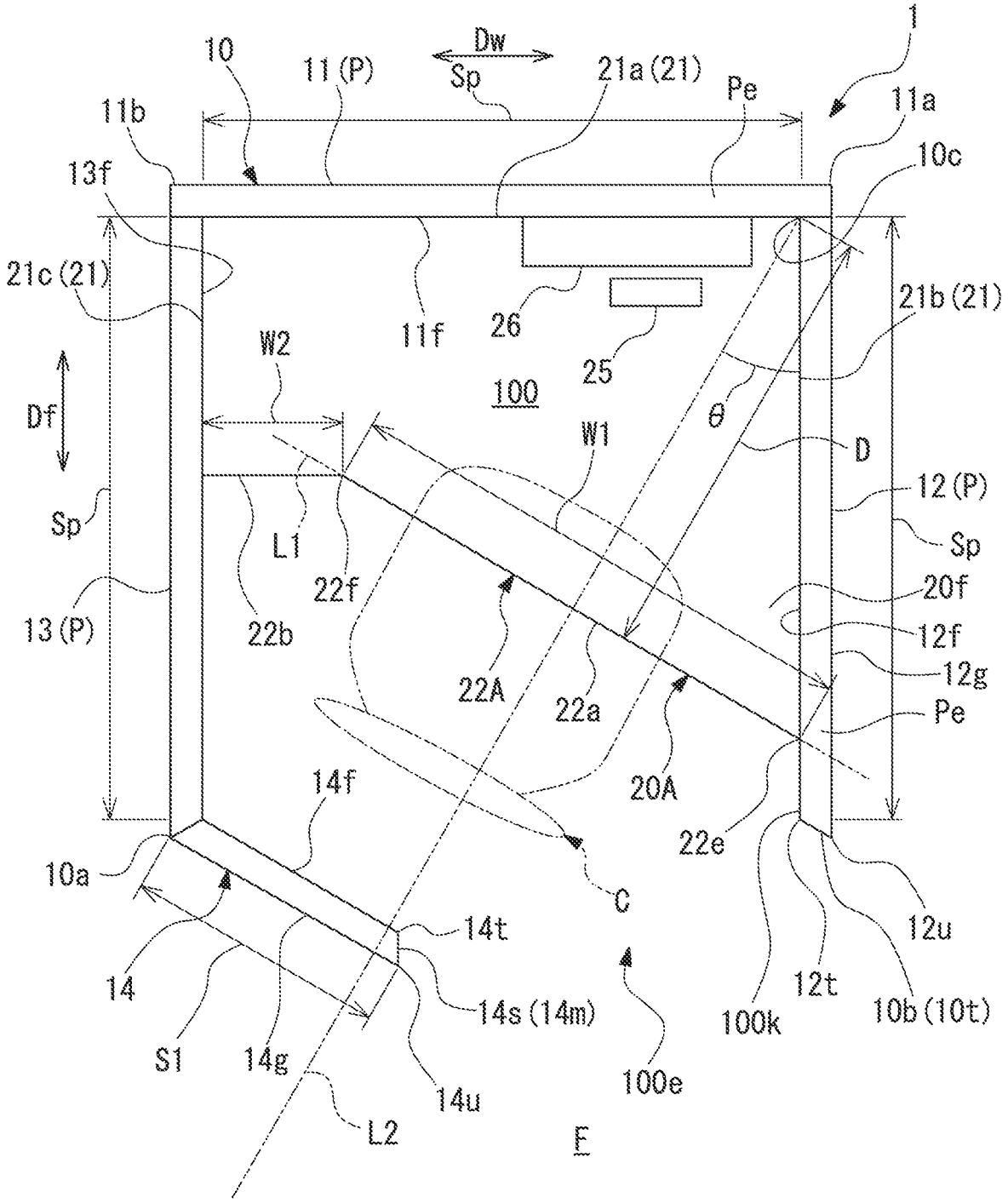
FIG. 2 is a plan view of the booth.

FIG. 1 is a perspective view showing the overall configuration of a booth 1 according to the embodiment of the present invention. FIG. 2 is a plan view of the booth 1.

As shown in FIGS. 1 and 2, the booth 1 includes a booth main body 10, an inclined panel 14, and a top plate 20A.

The booth main body 10 is installed on a floor surface F. The booth main body 10 is configured by combining a facing panel (a first panel) 11, a right-side panel (a second panel) 12, and a left-side panel (a third panel) 13. The facing panel 11, the right-side panel 12, and the left-side panel 13 are erected in a direction orthogonal to the floor surface F.

In the following description, a right-left direction when the facing panel 11 is horizontally seen in a direction orthogonal to an inner surface 11*f* (a surface that faces the inside of the booth main body 10) thereof is referred to as a width direction Dw, a direction (a thickness direction of the facing panel 11) that is orthogonal to the inner surface 11*f* of the facing panel 11 and that is parallel with a horizontal plane is referred to as a front-rear direction Df, and a direction that is orthogonal to the width direction Dw and the front-rear direction Df is referred to as a vertical direction Dv. Furthermore, in the front-rear direction Df, the facing panel 11 side of the booth main body 10 is referred to as a rear side, and the opposite side thereto is referred to as a front side. In addition, in the following description, a "plan view" represents a case where the booth main body 10 is seen in a direction downward from above.

The facing panel 11 is erected on the floor surface F in the vertical direction Dv that is orthogonal to the floor surface F. The facing panel 11 has a rectangular plate shape that is long in the vertical direction Dv.

The right-side panel 12 is disposed on a first side (a right side) in the width direction Dw of the facing panel 11. The right-side panel 12 has a rectangular plate shape that is long in the vertical direction Dv and is erected on the floor surface F. The right-side panel 12 is connected to a right end portion 11*a* of the facing panel 11. The right-side panel 12 extends forward from the end portion 11*a* of the facing panel 11.

The left-side panel 13 is disposed on a second side (a left side) in the width direction Dw of the facing panel 11. The left-side panel 13 has a rectangular plate shape that is long in the vertical direction Dv and is erected on the floor surface F. The left-side panel 13 is connected to a left end portion 11*b* of the facing panel 11. The left-side panel 13 extends forward from the end portion 11*b* of the facing panel 11. In the present embodiment, the right-side panel 12 and the left-side panel 13 are orthogonal to the inner surface 11*f* of the facing panel 11 in a plan view and extend in parallel with each other. However, it is sufficient that the right-side panel 12 and the left-side panel 13 extend in the front-rear direction Df in a state where the right-side panel 12 and the left-side panel 13 face each other in the width direction Dw.

Each of the facing panel 11, the right-side panel 12, and the left-side panel 13 is configured of a panel body P having a similar structure. The panel body P includes, for example, a rectangular panel main body (not shown), frame materials Pe provided along the four sides of the panel main body, and a leg portion (not shown) provided on a lower side frame material and grounded on the floor surface F. Note that the material and the structure of the panel body P are not limited in any way, and a configuration other than a configuration as described above can be appropriately adopted. In addition, the facing panel 11, the right-side panel 12, and the left-side panel 13 may be integrated.

Inside the booth main body 10, a booth interior space 100 with an opening 100*k* that faces forward is formed by being surrounded by the facing panel 11, the right-side panel 12, and the left-side panel 13. In the present embodiment, the facing panel 11, the right-side panel 12, and the left-side panel 13 have an equal panel width Sp on a side thereof facing the booth interior space 100. As a result, the booth main body 10 has a square shape in the plan view. However, the panel widths Sp of the panels 11, 12, and 13 may be different from each other.

The top plate 20A is provided in the booth main body 10. The top plate 20A has a plate shape and is provided along a horizontal plane orthogonal to the vertical direction Dv. An upper surface of the top plate 20A constitutes a flat work surface 20*f*.

As shown in FIG. 2, the top plate 20A includes a panel side edge portion 21 and a front edge portion 22A. The panel side edge portion 21 includes a rear edge 21*a* that extends in the width direction Dw along the inner surface 11*f* of the facing panel 11, a right edge 21*b* that extends in the front-rear direction Df along an inner surface 12*f* of the right-side panel 12, and a left edge 21*c* that extends in the front-rear direction Df along an inner surface 13*f* of the left-side panel 13. The top plate 20A is fixed by a bracket (not shown), a leg (not shown) standing up from the floor surface F, or the like in a state where the panel side edge portion 21 is aligned with the facing panel 11, the right-side panel 12, and the left-side panel 13. Note that the panel side edge portion 21 may not be in contact with the inner surfaces 11*f* to 13*f* of the panels 11 to 13 facing the panel side edge portion 21 as long as the panel side edge portion 21 is close to the inner surfaces 11*f* to 13*f*.

The front edge portion 22A of the top plate 20A includes a first edge portion 22*a* and a second edge portion 22*b*. The first edge portion 22*a* is positioned on a right side (the right-side panel 12 side) of the front edge portion 22A with respect to the second edge portion 22*b*.

The first edge portion 22*a* extends to be inclined rearward to become gradually closer to the facing panel 11 from a first end 22*e*, which is a right end, toward a second end 22*f*, which is a left end. In the present embodiment, the first edge portion 22*a* extends linearly in the plan view from the first end 22*e* to the second end 22*f*. The first end 22*e* of the first edge portion 22*a* constitutes a right end of the entire front edge portion 22A. That is, the first end 22*e* is joined to the front end of the right edge 21*b*. In contrast, the second end 22*f* of the first edge portion 22*a* is separated from the left-side panel 13 in the width direction Dw. Note that the first end 22*e* is disposed behind a front-end portion (a first end portion) 10*b* (hereinafter, referred to as a booth right front-end portion 10*b*) of the right-side panel 12 by a predetermined length.

The second edge portion 22*b* extends leftward from the second end 22*f* of the first edge portion 22*a*. The second edge portion 22*b* extends linearly in the width direction Dw in the plan view and is orthogonal to the inner surface 13*f* of the left-side panel 13. Note that the second end 22*f* of the first edge portion 22*a* and the second edge portion 22*b* constitute a rearmost portion of the front edge portion 22A and are closest to the facing panel 11.

The front edge portion 22A of the top plate 20A is formed such that a width W1 thereof in a direction (a direction connecting the first end 22*e* and the second end 220 in which the first edge portion 22*a* extends is greater than a width W2 of the second edge portion 22*b* in a direction (the width direction Dw) in which the second edge portion 22*b* extends.

In addition, the top plate 20A is provided with, for example, a wire insertion portion 25 through which various wires that are connected to electric devices to be used on the work surface 20*f* are inserted. In addition, a lighting device 26 is provided above the work surface 20*f* of the top plate 20A. The lighting device 26 is fixed to, for example, the facing panel 11 of the booth main body 10. Note that the top plate 20A or the booth main body 10 can be provided with various optional members other than the wire insertion portion 25 and the lighting device 26.

In the booth interior space 100, a chair C is provided at a position facing the first edge portion 22*a*. The chair C is configured to be rotatable around an axis extending in the vertical direction Dv. The chair C may be fixed to, for example, the floor surface F or may be able to travel on the floor surface F by casters or the like. In addition, the chair C may be supported by an arm or the like extending from the booth main body 10.

The inclined panel 14 is connected to a front-end portion (a first end portion) 10*a* (hereinafter, referred to as a booth left front-end portion 10*a*) of the left-side panel 13. The inclined panel 14 extends to be inclined forward (in a direction farther from the facing panel 11) and rightward from the booth left front-end portion 10*a*. A tip end portion 14*s* (an end portion distant from the booth left front-end portion 10*a*) of the inclined panel 14 is disposed with a distant from the booth right front-end portion 10*b*. Accordingly, an entrance 100*e* for entering and exiting the booth interior space 100 is formed between the tip end portion 14*s* of the inclined panel 14 and the booth right front-end portion 10*b*.

In the present embodiment, the inclined panel 14 extends linearly in the plan view. The inclined panel 14 extends to be parallel with the first edge portion 22*a* of the top plate 20A in the plan view.

A first virtual line L1 connects the first end 22*e* and the second end 22*f* of the first edge portion 22*a* of the front edge portion 22A, a second virtual line L2 is orthogonal to the first virtual line L1 and passes through a corner portion 10*c* between the facing panel 11 and the right-side panel 12, and the inclined panel 14 is positioned on a second virtual line L2. In the present embodiment, the second virtual line L2 intersects the inclined panel 14 at a portion positioned close to the tip end portion 14*s*. That is, the second virtual line L2 intersects the inclined panel 14 at a portion that is closer to the tip end portion 14*s* than the middle portion in a direction in which the inclined panel 14 extends. However, it is sufficient that the second virtual line L2 intersects the inclined panel 14 within a panel width S1 of the inclined panel 14 (a length on an outer surface 14*g* of the inclined panel 14). Here, the inclined panel 14 and the top plate 20A (the first edge portion 22*a*) may be formed such that an angle θ equal to or less than, for example, 45° is formed between the second virtual line L2 and the inner surface 12*f* of the right-side panel 12 in the plan view.

In addition, the tip end portion 14*s* of the inclined panel 14 is formed to be inclined such that the length of the inclined panel 14 in the direction (a panel width direction) in which the inclined panel 14 extends gradually decreases from an end portion 14*u* of the tip end portion 14*s* on the outer surface 14*g* (a surface that faces the outside of the booth main body 10) side of the inclined panel 14 toward an end portion 14*t* of the tip end portion 14*s* on an inner surface 14*f* (a surface that faces the inside of the booth main body 10) side of the inclined panel 14. Accordingly, the tip end portion 14*s* is provided with a tip end inclined surface 14*m* that is inclined with respect to the direction in which the inclined panel 14 extends. In an example shown in the drawing, the tip end inclined surface 14*m* extends in the front-rear direction Df. However, in the tip end inclined surface 14*m*, the end portion 14*t* on the inner surface 14*f* side may be positioned on the left of the end portion 14*u* on the outer surface 14*g* side and may be positioned on the right of the end portion 14*u* on the outer surface 14*g* side.

The booth right front-end portion 10*b* of the booth main body 10 is formed to be inclined such that a panel width of the right-side panel 12 in a direction (the front-rear direction Df) in which the right-side panel 12 extends gradually decreases from an end portion 12*u* of the booth right front-end portion 10*b* on an outer surface 12*g* (a surface that faces the outside of the booth main body 10) side of the right-side panel 12 toward an end portion 12*t* of the booth right front-end portion 10*b* on the inner surface 12*f* (a surface that faces the inside of the booth main body 10) side of the right-side panel 12. Accordingly, the booth right front-end portion 10*b* is provided with a front-end inclined surface 10*t* of which the end portion 12*t* on the inner surface 12*f* side is positioned behind the end portion 12*u* on the outer surface 12*g* side. Note that the tip end portion 14*s* of the inclined panel 14 and the booth right front-end portion 10*b* may be flat surfaces extending in directions orthogonal to respective extending directions thereof.

In addition, the inclined panel 14 may be provided such that the panel width S1 on the outer surface 14*g* from the booth left front-end portion 10*a* is less than the width W1 of the first edge portion 22*a* of the top plate 20A. In addition, the panel width S1 of the inclined panel 14 may be equal to or less than ½ of the panel width Sp of the facing panel 11. Accordingly, the width of the entrance 100*e* between the tip end portion 14*s* of the inclined panel 14 and the booth right front-end portion 10*b* is secured widely.

A user of the booth 1 as described above enters and exits the booth main body 10 (the booth interior space 100) through the entrance 100*e* formed between the tip end portion 14*s* of the inclined panel 14 and the booth right front-end portion 10*b*. The user sits on, for example, the chair C in the booth 1 and uses the work surface 20*f* on the top plate 20A in a state of facing the first edge portion 22*a* of the top plate 20A. At this time, the user does not straight face the facing panel 11 but straight faces the first edge portion 22*a* of the top plate 20A. As a result, the user is caused to face a right end portion (the corner portion 10*c* between the facing panel 11 and the right-side panel 12) of the facing panel 11 in the plan view.

In this state, the inclined panel 14 is provided behind the user to block a view from behind the user. In addition, since the entrance 100*e* is formed in the right of the user, a feeling of blockage felt by the user can be limited. In addition, the user can visually recognize a person approaching from the right easily through the entrance 100*e*. In addition, the user inside the booth 1 is visually recognized easily when being viewed from the outside of the booth 1 through the entrance 100*e*.

As described above, in the present embodiment, the booth 1 includes the booth main body 10 including the facing panel 11, the right-side panel 12, and the left-side panel 13, the top plate 20A, and the inclined panel 14 that extends from the booth left front-end portion 10*a* of the booth main body 10 to be inclined. The top plate 20A includes the front edge portion 22A including the first edge portion 22*a* that extends in a direction to become closer to the facing panel 11 from the first end 22*e* on the right-side panel 12 side of the front edge portion 22A toward the left-side panel 13.

According to such a configuration, since the front edge portion 22A of the top plate 20A is provided with the first edge portion 22*a*, the user who faces the first edge portion 22*a* of the top plate 20A faces the corner portion 10*c* between the facing panel 11 and the right-side panel 12. In this case, as seen from the user of the top plate 20A, the inclined panel 14 is provided behind the user, and thus a workspace on the top plate 20A is limited from being viewed from behind the user.

In addition, since the booth main body 10 has a rectangular shape in the plan view, a dead space being formed between the booth main body 10 and other fixtures, walls, and the like provided in an installation space in which the booth 1 is installed can be limited.

In addition, since the inclined panel 14 is inclined in the same direction as the first edge portion 22*a* of the front edge portion 22A of the top plate 20A, a decrease in the distance between the inclined panel 14 and the front edge portion 22A of the top plate 20A is limited, and thus accessibility with respect to the inside and the outside of the booth main body 10 is made favorable. Furthermore, the work surface

20*f* of the top plate 20A extends diagonally from the front edge portion 22A toward the corner portion 10*c*, and a large depth D (in a direction along the second virtual line L2) on the work surface 20*f* as seen from the user can be secured. In addition, in a case where the user uses the work surface 20*f* of the top plate 20A while sitting on the chair C, a space for accommodation of the legs of the user that is under the top plate 20A can also be secured diagonally and widely from the front edge portion 22A of the top plate 20A toward the corner portion 10*c*. Accordingly, even if the booth main body 10 is reduced in size, usability in the booth 1 can be improved.

Therefore, according to the booth 1, it is possible to increase a space use efficiency in an installation space and to improve usability while limiting a workspace on the top plate 20A from being viewed from behind the user.

In the present embodiment, the inclined panel 14 is configured to be disposed on the second virtual line L2 that is orthogonal to the first virtual line L1 connecting the first end 22*e* of the front edge portion 22A and the second end 22*f* of the front edge portion 22A that is positioned to be closest to the facing panel 11, and the second virtual line L2 passes through the corner portion 10*c*.

According to such a configuration, the inclined panel 14 is positioned behind the user who uses the work surface 20*f* on the top plate 20A while facing the first edge portion 22*a* of the top plate 20A. Therefore, it is possible to more reliably prevent the workspace on the top plate 20A from being viewed from behind the user.

In the present embodiment, the front edge portion 22A is configured to include the second edge portion 22*b* that extends from the second end 22*f* toward the left-side panel 13.

According to such a configuration, the work surface 20*f* that extends leftward further than the second end 22*f* is formed on a left side of the top plate 20A as seen from a worker facing the first edge portion 22*a*. Accordingly, a space on the work surface 20*f* of the top plate 20A is widened, and usability for the worker is improved.

In the present embodiment, the first end 22*e* of the top plate 20A is configured to be disposed in front of the booth right front-end portion 10*b* of the booth main body 10.

According to such a configuration, the right-side panel 12 of the booth main body 10 protrudes rearward further than the first end 22*e* of the top plate 20A. Thereby, a line of sight from an area close to the right-side panel 12 as seen from the worker can be blocked by the right-side panel 12. Accordingly, usability for the worker is improved.

In the present embodiment, the first edge portion 22*a* of the top plate 20A and the inclined panel 14 are configured to extend linearly in the plan view.

According to such a configuration, the first edge portion 22*a* of the top plate 20A and the inclined panel 14 can be easily manufactured, and thus the booth 1 can be provided at a lower cost.

In the present embodiment, the inclined panel 14 is configured to extend to be parallel with the first edge portion 22*a* of the top plate 20A in the plan view.

According to such a configuration, a decrease in the distance between the tip end portion 14*s* of the inclined panel 14 and the front edge portion 22A of the top plate 20A is limited, and thus a decrease in accessibility with respect to the inside and the outside of the booth main body 10 can be limited.

In the present embodiment, a configuration in which the panel width S1 of the inclined panel 14 from the booth left front-end portion 10*a* is less than the width W1 of the first edge portion 22*a* of the top plate 20A is adopted.

According to such a configuration, it is possible to limit a decrease in width of the entrance 100*e* caused by the panel width S1 of the inclined panel 14 being made excessively large. Accordingly, a decrease in accessibility with respect to the inside and the outside of the booth main body 10 can be limited.

In the present embodiment, the booth right front-end portion 10*b* of the right-side panel 12 and the tip end portion 14*s* of the inclined panel 14 are configured to be inclined such that the panel widths of the panels 12 and 14 decrease from the outer surfaces 12*g* and 14*g* toward the inner surfaces 12*f* and 14*f* in the plan view.

According to such a configuration, interference with respect to the end portion 14*t* on the inner surface 14*f* side of the tip end portion 14*s* of the inclined panel 14 or the end portion 12*t* on the inner surface 12*f* side of the booth right front-end portion 10*b* is limited at the time of an entrance into the booth main body 10 or an exit from the booth main body 10, and thus a decrease in accessibility with respect to the inside and the outside of the booth main body 10 can be limited.

(Modification Examples of Embodiment)

Next, modification examples of the booth according to the present invention will be described. Note that in each modification example described below, the configuration of a front edge portion of a top plate is different from that of the front edge portion 22A described in the above embodiment.

(First Modification Example)

Figure 3:
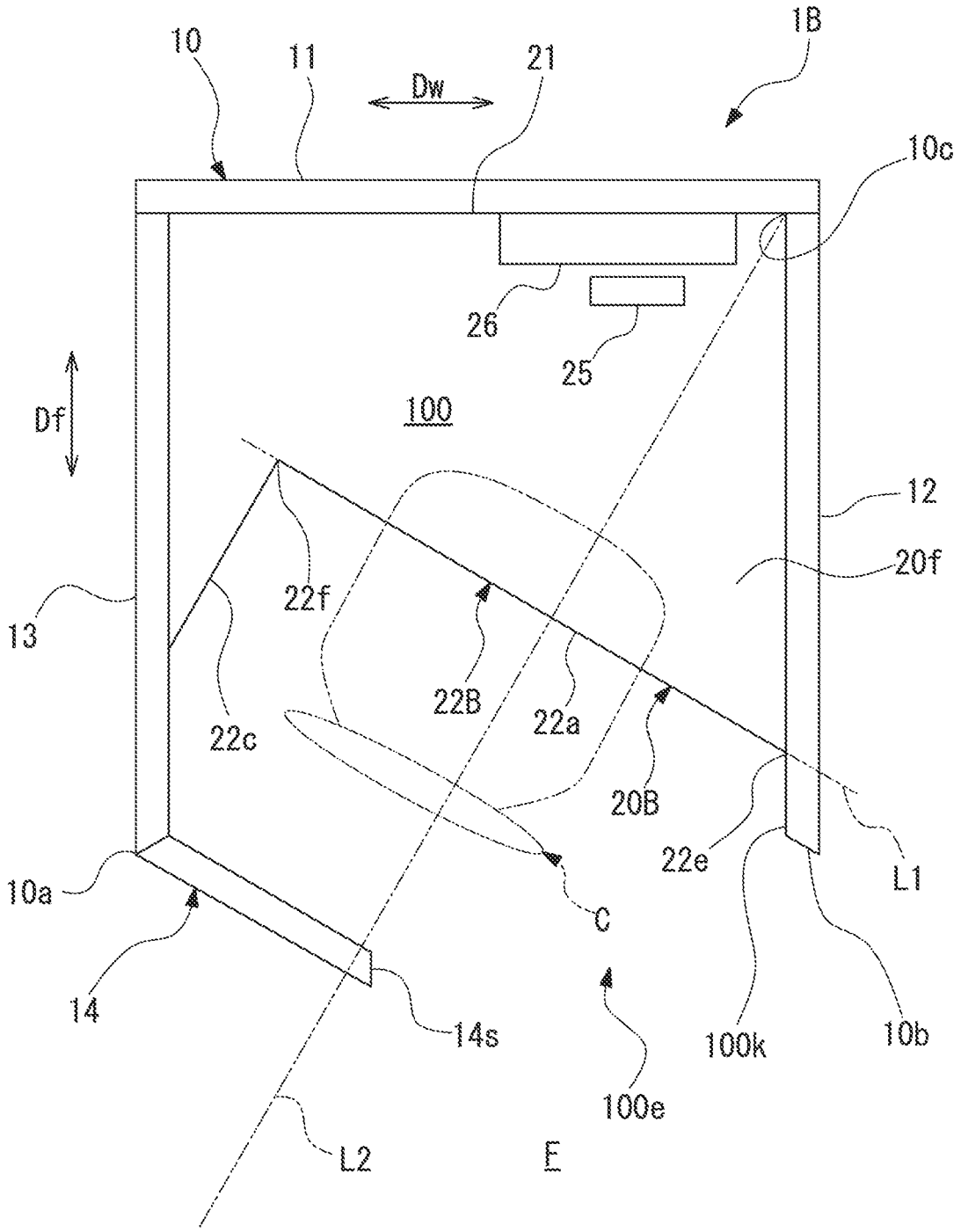
FIG. 3 is a plan view of a booth according to a first modification example of the embodiment of the present invention.

FIG. 3 is a plan view of a booth 1B according to a first modification example of the embodiment of the present invention.

As shown in FIG. 3, a second edge portion 22*c* of a front edge portion 22B of a top plate 20B provided in the booth 1B extends to be inclined forward and leftward from the second end 22*f* of the first edge portion 22*a*. The second edge portion 22*c*, for example, extends to be orthogonal to the first edge portion 22*a* in the plan view. Note that a direction in which the second edge portion 22*c* extends may not be orthogonal to the first edge portion 22*a* in the plan view.

Even in a case where the front edge portion 22B is formed in a V shape in the plan view as described above, it is sufficient that the inclined panel 14 is disposed on the second virtual line L2 that is orthogonal to the first virtual line L1 connecting the first end 22*e* and the second end 22*f* of the first edge portion 22*a*, and the second virtual line L2 passes through the corner portion 10*c* between the facing panel 11 and the right-side panel 12. In the first modification example of the present embodiment, a space on the work surface 20*f* of the top plate 20A is widened on the left-side panel 13 side of the top plate 20A as seen from a worker who is positioned to face the first edge portion 22*a* of the top plate 20B, and thus usability for the worker is improved.

(Second Modification Example)

Figure 4:
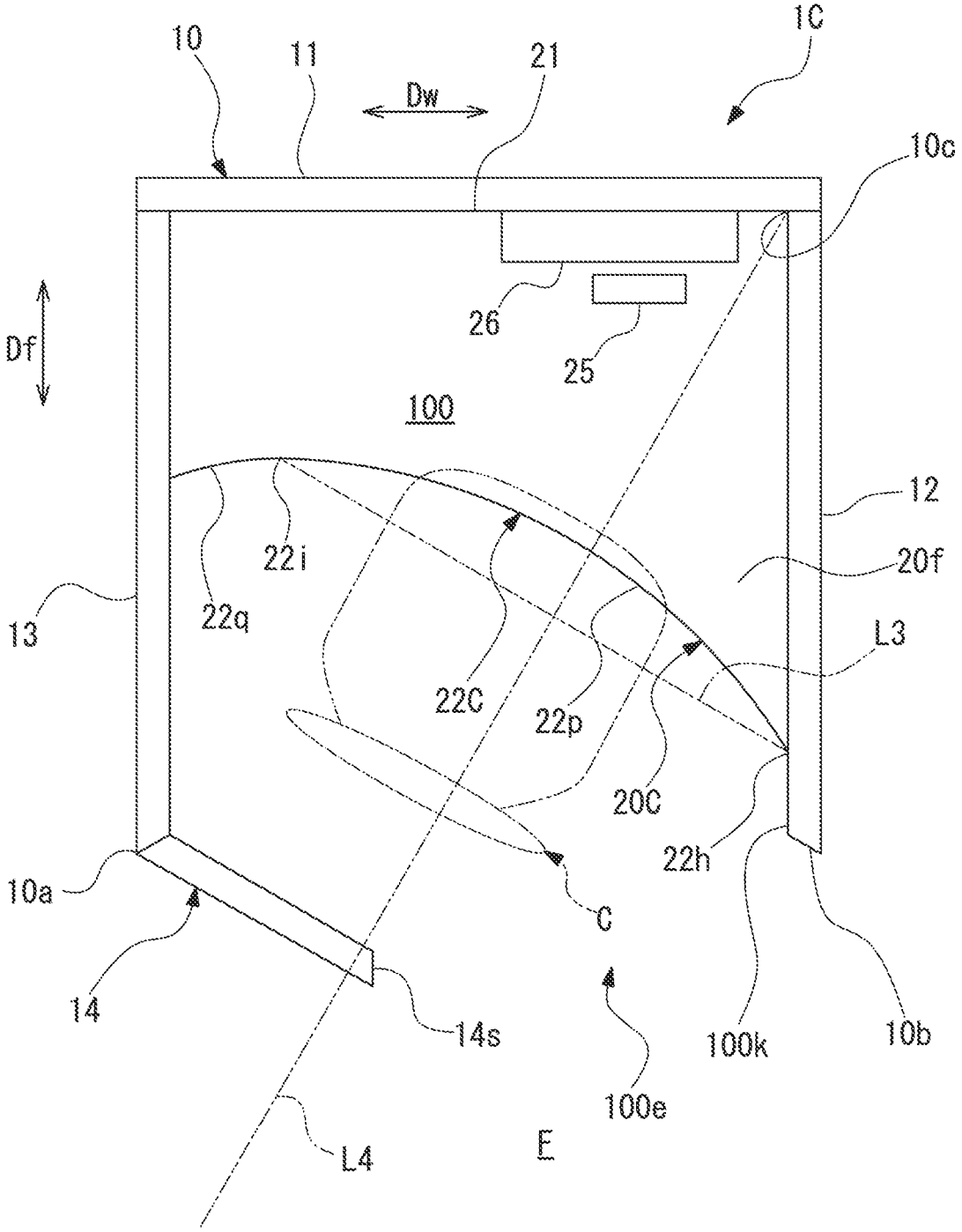
FIG. 4 is a plan view of a booth according to a second modification example of the embodiment of the present invention.

FIG. 4 is a plan view of a booth 1C according to a second modification example of the embodiment of the present invention.

As shown in FIG. 4, a front edge portion 22C of a top plate 20C provided in the booth 1C has an arc shape protruding rearward in the plan view. Specifically, the front edge portion 22C includes a first edge portion 22*p* and a second edge portion 22*q*. The first edge portion 22*p* is formed on a right side of the front edge portion 22C with respect to the second edge portion 22*q*.

The first edge portion 22*p* extends rearward to become gradually closer to the facing panel 11 from a first end 22*h*, which is a right end, toward a second end 22*i*, which is a left end, in the width direction Dw. In the present embodiment, the first edge portion 22*p* extends to be curved rearward from the first end 22*h* to the second end 22*i*.

The second edge portion 22*q* extends to be curved forward from the second end 22*i* of the first edge portion 22*p* toward the left-side panel 13. Therefore, the second end 22*i* of the first edge portion 22*p* is a portion of the front edge portion 22C that is closest to the facing panel 11. Note that the first edge portion 22*p* and the second edge portion 22*q* are formed to have an equal radius of curvature. However, the radiuses of curvature of the first edge portion 22*p* and the second edge portion 22*q* may be different from each other.

A first virtual line L3 connects the first end 22*h* and the second end 22*i* of the front edge portion 22C, a second virtual line L4 is orthogonal to the first virtual line L3 and passes through the corner portion 10*c* between the facing panel 11 and the right-side panel 12, and the inclined panel 14 is disposed on the second virtual line L4.

(Third Modification Example)

In addition, in the above-described embodiment and the two modification examples, the front edge portions 22A to 22C include the first edge portions 22*a* and 22*p* and the second edge portions 22*b*, 22*c* and 22*q*. However, the present invention is not limited thereto.

Figure 5:
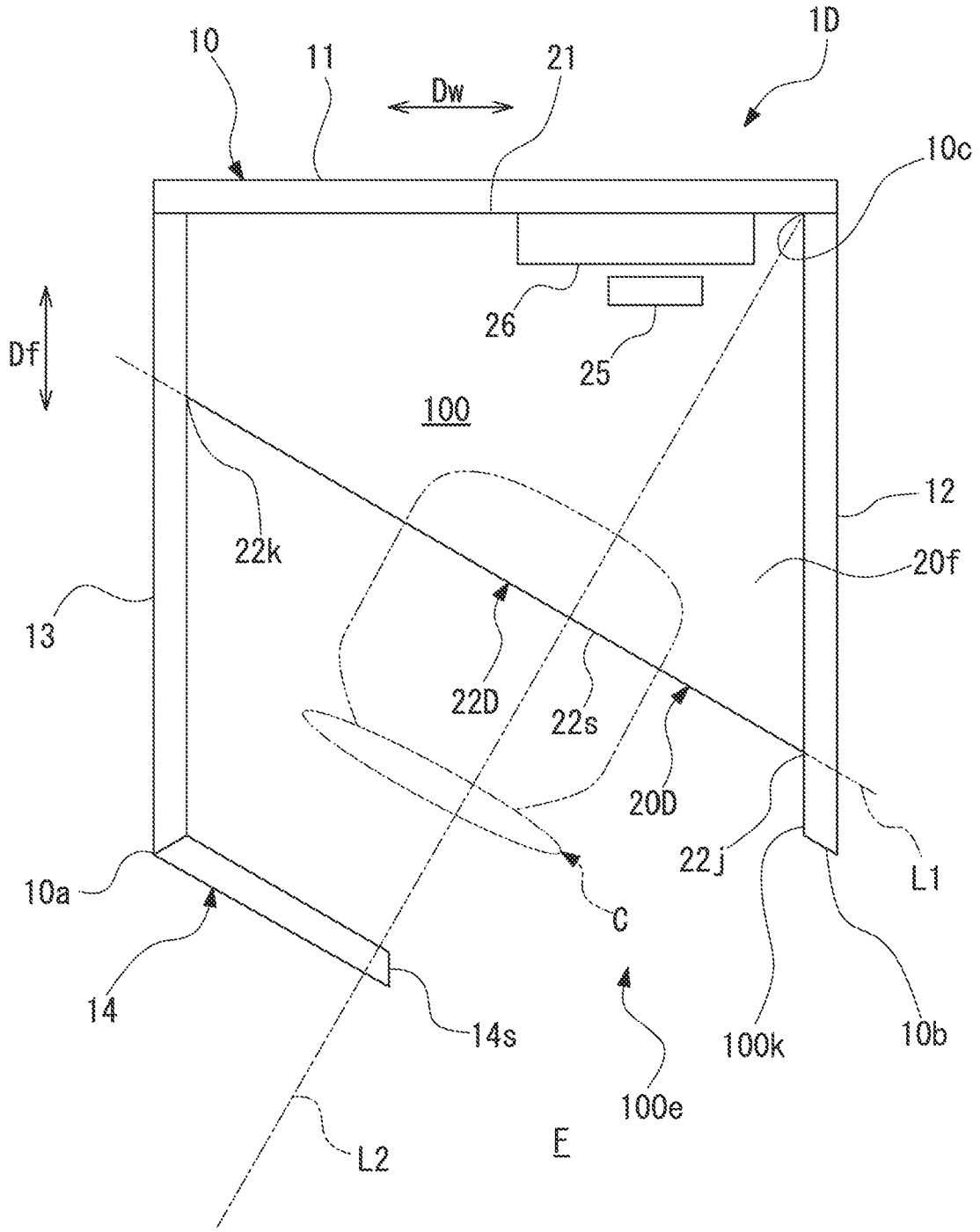
FIG. 5 is a plan view of a booth according to a third modification example of the embodiment of the present invention.

FIG. 5 is a plan view of a booth 1D according to a third modification example of the embodiment of the present invention.

As shown in FIG. 5, a front edge portion 22D of a top plate 20D provided in the booth 1D includes only a first edge portion 22*s*. The first edge portion 22*s* extends rearward to become gradually closer to the facing panel 11 from a first end 22*j*, which is a right end, toward a second end 22*k*, which is a left end, in the width direction Dw. In this case, the second end 22*k* is a portion of the front edge portion 22D that is closest to the facing panel 11. In addition, in the present modification example as well, the first virtual line L1 connects the first end 22*j* and the second end 22*k*, the second virtual line L2 is orthogonal to the first virtual line L1 and passes through the corner portion 10*c* between the facing panel 11 and the right-side panel 12, and the inclined panel 14 is disposed on the second virtual line L2.

(Other Embodiments)

Hereinbefore, practical examples of the present invention and modification examples thereof have been described. However, the present invention is not limited to the practical examples and the modification examples. Configurations may be added, omitted, replaced or modified within the scope of the present invention. The present invention is not limited by the above description but only by the appended claims.

For example, in the above-described embodiment, each of the first edge portions 22*a*, 22*p* and 22*s* of the top plate 20A has a linear shape or a curved shape. However, the shape thereof may be, for example, a wavy shape or a curved shape protruding rearward in the plan view instead of the linear shape or the curved shape of the above embodiment.

In the above-described embodiment, a configuration in which the first ends 22*e*, 22*h* and 22*j* of the top plates 20A, 20B, 20C and 20D are disposed behind the booth right front-end portion 10*b* has been described. However, the present invention is not limited thereto. The first end 22*e* of the top plate 20A may be disposed at the same position as the booth right front-end portion 10*b* in the front-rear direction Df.

In the above-described embodiment, a configuration in which the panel side edge portion 21 of each of the top plates 20A, 20B, 20C and 20D includes the rear edge 21*a*, the right edge 21*b*, and the left edge 21*c* has been described. However, the present invention is not limited thereto. It is sufficient that the panel side edge portion 21 includes at least the rear edge 21*a* and the right edge 21*b* with the corner portion 10*c* interposed therebetween.

In the above-described embodiment, for example, a configuration in which the work surface 20*f* of the top plate 20A is flat along a horizontal plane has been described. However, the present invention is not limited thereto. For example, the work surface 20*f* of the top plate 20A may be inclined downward and toward the front edge portion 22A, which is a user side edge portion. That is, it is sufficient that in the front edge portion 22A, the first edge portion 22*a* extends to be inclined rearward to become gradually closer to the facing panel 11 from the first end 22*e*, which is a right end, toward the second end 22*f*, which is a left end, in the plan view. In addition, for example, the top plate 20A may be configured to be able to be moved up and down.

In the above-described embodiment, the first edge portions 22*a* and 22*s* of the top plate 20A and the inclined panel 14 are provided to be parallel with each other. However, the present invention is not limited thereto. The first edge portions 22*a* and 22*s* of the top plate 20A and the inclined panel 14 may not be parallel with each other.

In the above-described embodiment, a configuration in which the inclined panel 14 is connected to the left-side panel 13 has been described. However, the inclined panel 14 may be connected to the right-side panel 12.

In the above-described embodiment, the booth main body 10 has a square shape in the plan view. However, the booth main body 10 may have a rectangular shape that is long in the width direction Dw or the front-rear direction Df in the plan view.

In addition, it is possible to appropriately replace a component in the above-described embodiment with a well-known component within the scope of the present invention, and the above-described modification examples may be appropriately combined with each other.

Industrial Applicability

The present invention can be used for a booth including a booth main body, a top plate, and an inclined panel.

What is claimed is:

1. A booth comprising:

a booth main body that includes a first panel, a second panel, and a third panel, the first panel being erected on a floor surface, and the second panel and the third panel being connected to two end portions in a width direction of the first panel and extending in a thickness direction of the first panel in a state where the second panel and the third panel face each other in the width direction;

a top plate that is provided in the booth main body and of which an upper surface includes a work surface; and an inclined panel that is connected to a first end portion of the third panel positioned on a side of the third panel distant from the first panel in a plan view, extends to be inclined to become farther from the first panel toward the second panel in the width direction, and forms an entrance into the booth main body between the inclined panel and a first end portion of the second panel positioned on a side of the second panel distant from the first panel, wherein the top plate includes a panel side edge portion that extends along the first panel and the second panel, and a front edge portion that includes a first edge portion extending in a direction such that the first edge portion becomes closer to the first panel from a first end of the front edge portion positioned on the second panel side of the front edge portion toward the third panel in the width direction, the inclined panel is distanced from the front edge portion of the top plate, and a position in the booth is defined where a user faces the first edge portion of the top plate and uses the work surface of the top plate, and the inclined panel is provided behind the user in the position.

2. The booth according to claim 1, wherein in the plan view, a first virtual line connects the first end and a second end of the front edge portion positioned closest to the first panel, a second virtual line is orthogonal to the first virtual line and passes through a corner portion between the first panel and the second panel, and the inclined panel is disposed on the second virtual line.

3. The booth according to claim 2, wherein the second end of the front edge portion is separated from the third panel in the width direction, and the front edge portion includes a second edge portion that extends from the second end toward the third panel.

4. The booth according to claim 1, wherein the first end of the top plate is disposed to be closer to the first panel than the first end portion of the second panel.

5. The booth according to claim 1, wherein the first edge portion of the top plate and the inclined panel extend linearly in the plan view.

6. The booth according to claim 5, wherein the inclined panel extends to be parallel with the first edge portion of the top plate in the plan view.

7. The booth according to claim 1, wherein a panel width of the inclined panel from the first end portion of the third panel is less than a width of the first edge portion of the top plate.

8. The booth according to claim 1, wherein each of the first end portion of the second panel and a tip end portion of the inclined panel positioned on the second panel side of the inclined panel is inclined such that a panel width decreases from an outer surface facing an outside of the booth main body to an inner surface facing an inside of the booth main body in the plan view.

9. The booth according to claim 1, allowing the user that is in the position to be visible through the entrance from an outside.

* * * * *